United States Patent [19]

Drexler

[11] 4,354,772

[45] Oct. 19, 1982

[54] ROAD POST OR REFLECTOR POST

[76] Inventor: Joannes H. Drexler, Koppelweg 8-12, Doesburg, Netherlands

[21] Appl. No.: 152,200

[22] Filed: May 22, 1980

[30] Foreign Application Priority Data

Sep. 19, 1979 [BE] Belgium ..... 197213

[51] Int. Cl.[3] ..... E01F 9/00

[52] U.S. Cl. ..... 404/10; 256/13.1

[58] Field of Search ..... 404/10; 256/13.1, 1; 40/608, 607; 52/728, 730, 731

[56] References Cited

U.S. PATENT DOCUMENTS

| | | | |
|---|---|---|---|
| 1,824,578 | 9/1931 | Thake | 40/607 |
| 2,754,064 | 7/1956 | Voltz | 52/731 X |
| 3,502,007 | 7/1967 | Anderson | 404/10 |
| 3,631,789 | 1/1972 | Kinsey | 52/728 X |
| 3,802,135 | 4/1974 | Weichenrieder | 404/10 X |
| 3,927,698 | 12/1975 | Johannsen | 52/731 X |
| 3,989,396 | 11/1976 | Matsumoto et al. | 52/731 X |
| 3,999,353 | 12/1976 | Dielman | 52/731 |
| 4,249,357 | 2/1981 | Cornou | 40/608 X |

FOREIGN PATENT DOCUMENTS

| | | | |
|---|---|---|---|
| 748595 | 12/1966 | Canada | 404/10 |
| 1534502 | 6/1969 | Fed. Rep. of Germany | 40/607 |
| 2353941 | 6/1974 | Fed. Rep. of Germany | 256/13.1 |
| 1103370 | 2/1968 | United Kingdom | 256/13.1 |

*Primary Examiner*—Nile C. Byers, Jr.

[57] ABSTRACT

A road post or reflector formed of two identical disk shaped members each having a bottom wall, two longitudinal side walls and an end wall at at least one end. One side wall and half of the end wall having a projection and the other wall and other half of the endwall having a groove enabling the two members to be assembled by snap engagement.

7 Claims, 6 Drawing Figures

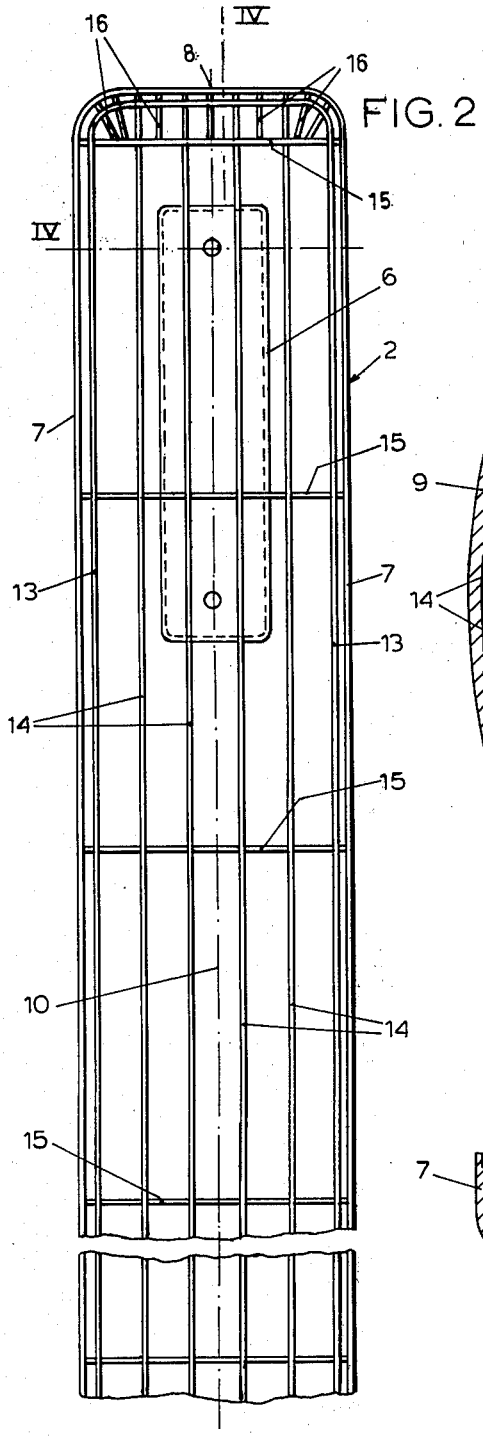
FIG. 2
FIG. 3
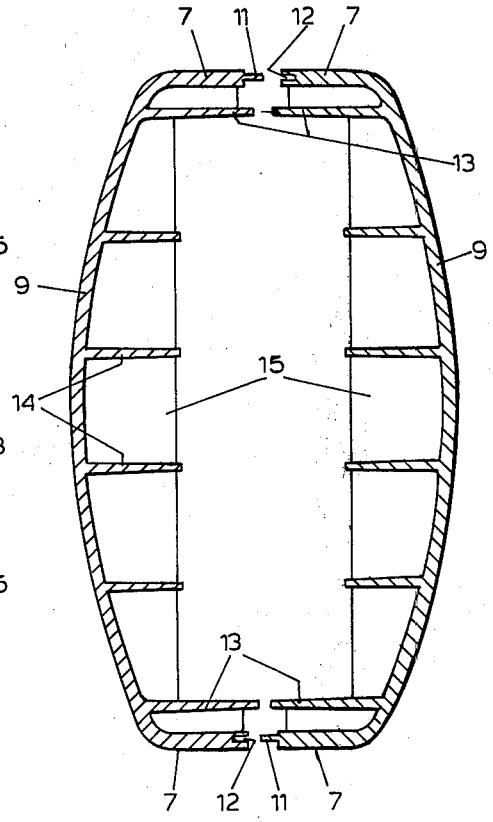
FIG. 4
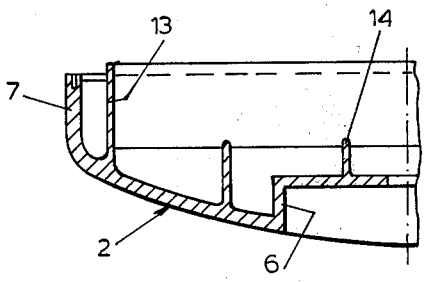

FIG. 5
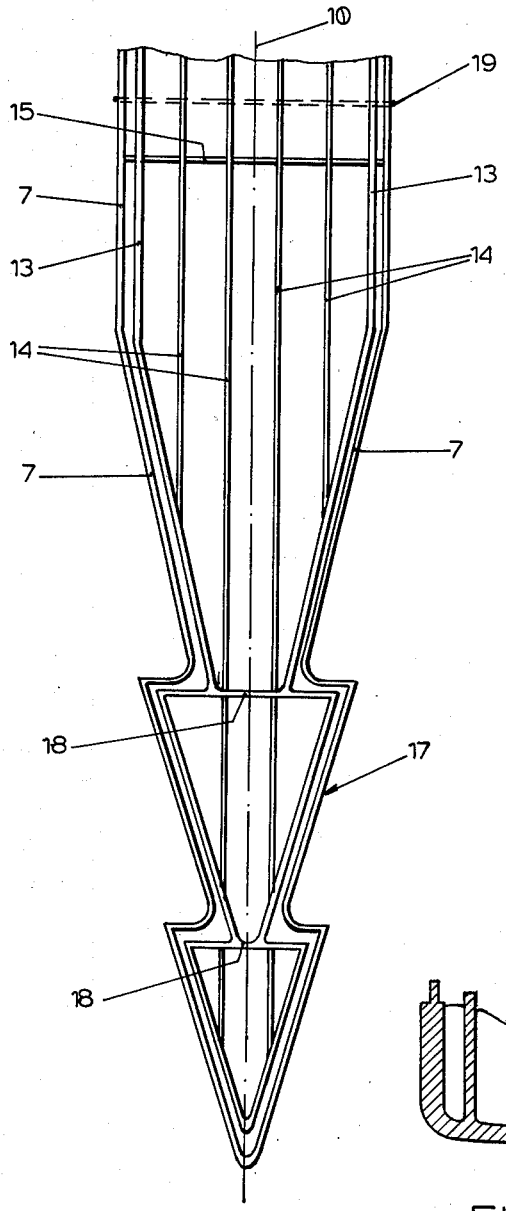
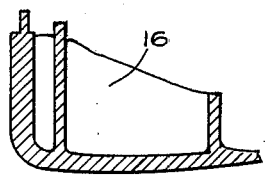
FIG. 6

ROAD POST OR REFLECTOR POST

BACKGROUND OF THE INVENTION

The invention relates to a road or reflector post manufactured of plastic material.

Road posts are known of an extruded body which has open ends, resulting from the extrusion process. On the pose end which is to constitute the upper end of the post a separate cap is placed which seats within the hollow upper end through a force fit. This cap serves among other purposes to permit the post to be driven into the ground without damaging it. However, the separate cap causes additional manufacturing and assembling cost.

SUMMARY OF THE INVENTION

The present invention aims at providing a road post which may be integrally manufactured and is sufficiently strong with minimal material consumption.

This is achieved according to the invention in that a post comprising two identical dish-shaped halves is provided. Each half is provided at its upper edge, upstanding from the dish bottom and to one side of the longitudinal symmetry plane of the dish, and to the other side of this plane with a groove adapted for engagement with the blade-shaped projection of the other dish-half.

When two halves are placed one on top of the other with one half turned upside down and their hollow sides opposite to each other, the blade-shaped projections may be snapped in the then opposing grooves.

Preferably to increase the rigidity and strenght of the structure it provided, closely adjacent to, within parallel to the outer edge of a dish-shaped half webs projecting from two post halves are snapped together the edges of the webs mutually engage so that they may be welded together under the application of heat. Molten and sagged material edges are generated by the welding process which bond together, invisible from the exterior of the post so that the appearance of the post is not impaired thereby.

In order to obtain sufficient strength and rigidity with small material thickness each post half is provided with reinforcement and/or rigidifying ridges in both or either of the longitudinal and the transverse directions.

Since the post head must permit the imparting of blows thereto without the generation of cracks or failures it is advantageous to provide additional reinforcement ridges formed at the one end of the road post, these ridges extending continually from a smaller height in the remainder of the dish to the outer edge of the upstanding wall of this post upper end. The longitudinal and transverse ridges in the remaining portion of the dish do not continue to the interface of the halves because then it is possible, as is often usual, to slide the post as a sheath onto a wooden supporting bar or standard which is secured in the ground, when providing the posts alongside the roads.

For that application the dish if formed at the longitudinal end remote from the post upper end without an upstanding outer edge portion.

One obtains a smoother exterior and less possibility of damage to any reflectors served thereon when the dish bottom has formed therin a recessed portion for receiving the reflector.

It is also possible to secure the road post according to the invention independently, without a wooden inner supporting post, in the ground. The dish is provided at its longitudinal end remote from the upper end with an outer edge portion which is shaped substantially with saw-tooth barbs, symmetrical with respect to the longitudinal symmetry plane of the dish and terminating in a sharp point, as a so called Christmastree foot or base.

The invention is further illustrated below with references to the drawing, which shows two embodiments of the road post according to the invention.

BRIEF DESCRIPTION OF THE DRAWINGS

FIG. 2 is a plan view of the interior of a dish half,

FIG. 3 shows incross-section two dish halves placed on top of each other, prior to their mutual connection, FIG. 4 is a partial cross-section along line IV—IV of FIG. 2, FIG. 5 shows a plan view a foot portion for a road post and, FIG. 6 is partial cross sectional views taken along line VI—VI of FIG. 2.

DESCRIPTION OF THE INVENTION

Figure 1:
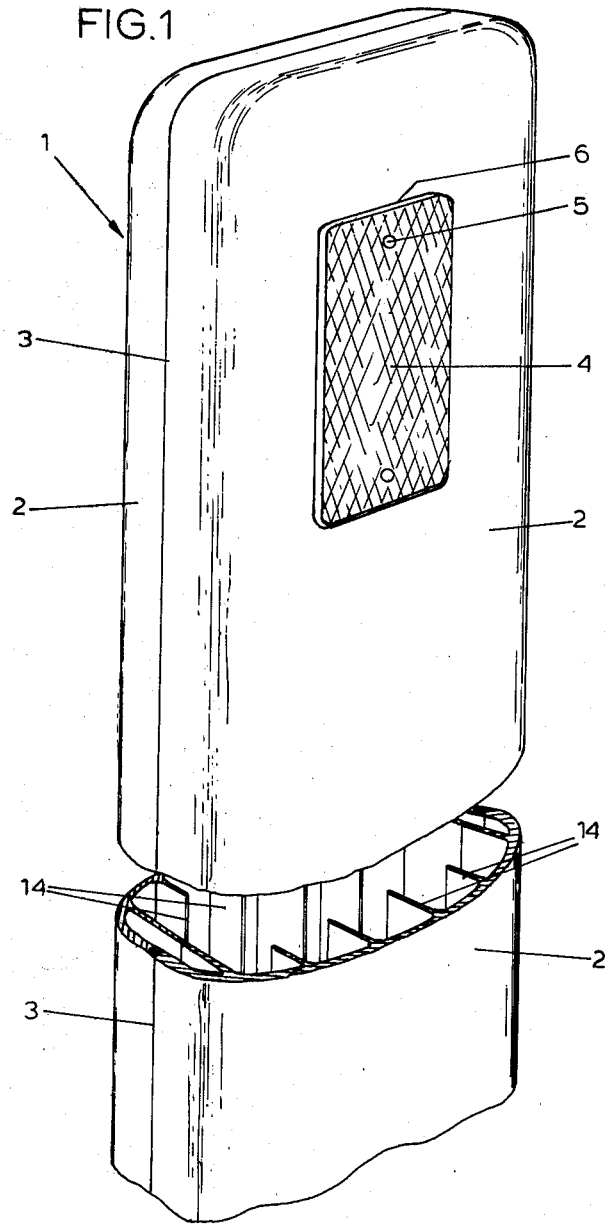
FIG. 1 is a partial perspective view of a post according to the invention.

The road post 1 as shown in FIG. 1 comprises two dish halves 2, mounted to each other; the connecting seam 3 showing that the post comprises two symmetric dish halves. To the front of the post a white reflector 4 has been secured through connection means 5 in a recess 6 on the outer surface of the one dish half 2, while in completely similar manner a red reflector has been secured to the back of the post (which cannot be seen in the drawing).

FIG. 2 shows a plan view of the interior of a post half 2. This post half is dish-shaped and has upstanding side walls 7 a head or end wall and a bottom wall 9 serving as the face of the post.

The lower end of the dish 2, situated at the lower end of the dish half shown in FIG. 2, is not illustrated in FIG. 2 but has in the first embodiment an open end, that is the bottom wall 9 together with both side edges end 7 in a plane perpendicular to the plane of the drawing, and also perpendicular to the longitudinal axis 10 of the dish. In this embodiment the plastic post as shown is in effect a sleeve which may be mounted on a supporting wooden inner post or bar, which post or bar in its turn is secured in the ground. The plastic post of this invention may extend to or below ground if desired. The lower end of the dish according to FIG. 2 may also be shaped according to FIG. 4., so that the plastic post is self supporting and may itself be driven into the ground. This relates to the second embodiment which will be discussed later on.

The dishes 2 are integrally formed through die casting in a mould in which the somewhat convex shaped dish bottom 9, the upstanding side edges 7 and the head wall 8 are formed.

As appears from FIG. 3 the edge of one side wall 7 of each dish is provided with a blade-shaped projection 11, being a continuation of said edge, while the edge of the other side wall 7 is provided with a groove 12 complementary to this projection. The blade-shaped projection or the groove respectively continue from the side wall up along the edge of the head or end wall 8; the projection as well as the groove terminating at the positon of the longitudinal axis 10.

When two dish halves 2 are placed with the hollow sides opposite to each other, as is shown in FIG. 3, by snapping the projection 11 in the opposing groove 12 bothe dishes become mutually connected from the road post. Of course the dimensions of the projection as well as of the groove are such that these parts may be engaged through the resiliency of the plastic as used so that thereby a certain retaining force is obtained.

In order to make the connection between both dish halves a web 13 extending adjacent to within and parallel to each outer side wall 7 and continuing along the head end wall 8 has been moulded integrally with the dish bottom and projecting therefrom. The edge of the webs of the two oppositely placed dishes meet each other when the dish halves are placed on top of each other, for which purpose the height of the webs has been chosen correspondingly. Through heat applied to the webs, the edges of webs are mutually welded, in mirror image, the material that has been molten hardens again on the interior of the post and 6 not visible on the exterior of the post.

For reinforceing and rigidifying the post further, longitudinal ridges 14 and transverse ridges 15 may be moulded integrally with the dish halves 2, upstanding from the bottom. Of course these ridges may have a different spacing and a different number than have been shown in the drawing.

Since the head of the post, at the position of the head end wall 8, must be able to receive blows when the plastic post is placed on the wooden inner post alternatively or in the ground, additional ridges 16 are formed as seen in FIG. 6 on the interior of the head end wall 8, wherein height may gradually increase from the transverse ridge 15 which is closest to the head end wall 8 to this head end wall 8 or the section of the welding web 13 parallel thereto respectively.

The recess 6 is formed in the face of the dish bottom 9, and is adapted to receive the reflectors 4 discussed above.

FIG. 5 shows a second embodiment for the base or foot of the post serving to place the post directly in the ground. In this embodiment a barbed foot 17 is formed by continuing the side walls 7 of the dish according to a converging stepped pattern, whereby a so called Christmastree foot or turbine blade foot is obtained. The welding web 13 likewise continues in the foot portion corresponding to the Christmastree contour parallel to the corresponding portions of the outer sides 7. At the point of the salient steps the welding webs at both sides of the longitudinal axis 10 are mutually connected as a continuous ridge 18 and additional longitudinal ridges are provided at these positions.

Preferably locating a mark 19 is provided in the form of a circumferential raised ridge on the exterior surface of the dish, perpendicular to the longitudinal axis 10, so that it may be seen how deep the post must be driven into the ground. When the ridge 19 is flush with the ground surface the portion of the post extending upwardly from the ground surface has the required height.

As a suitable plastic material for manufacturing the posts according to the invention the material Keltan may be mentioned, which is supplied to the market by DSM (de Staatsmijnen, a Dutch firm).

It will be clear that modifications within the field of the invention may be made to the embodiments as shown.

I claim:

1. A post comprising an elongate hollow body formed of a pair of identical dish shaped members symmetrical with respect to a plane of symmetry passing through a central longitudinal axis, each of said members having an integrally formed bottom wall, a pair of upstanding longitudinal side walls and an end wall at at least one end, the edge of one of said side walls and said at least one end wall on one side of said plane of symmetry being formed with a blade like projection and the edge of the other side wall and the remaining edge of said at least one end wall being formed with a conforming groove receiving said projection each of said members being provided with a longitudinally extending web closely adjacent and parallel to each of said side walls, said webs extending upstanding from the bottom wall to a height such that the edges thereof are in contact.

2. The post according to claim 1 wherein the contacting web members are welded together.

3. The post according to claim 1, wherein each member of said pair of dish shaped members is provided with longitudinal and transversely directed ridges for strengthening said member.

4. The post according to claim 3 including strengthening ridges associated with said at least one end wall extending continuously from a small height adjacent said bottom and side walls to a larger height adjacent said end wall.

5. The post according to claims 1, 2, 3 or 4 wherein the end of said members of said pair of dish shaped members remote from said at least one end wall is free of an end wall and said assembled pair of members is open.

6. The post according to claims 1, 2, 3 or 4, wherein the end of each of said members of said pair of dish shaped members remote from said at least one end is shaped and terminates in a sharp point.

7. The post according to claim 6, wherein said shaped end is substantially in the form of a saw-tooth whereby on assembling of said pair of dish shaped members a Christmastree foot base is provided.

* * * * *